US010094348B2

(12) United States Patent
Grandi

(10) Patent No.: US 10,094,348 B2
(45) Date of Patent: Oct. 9, 2018

(54) VALVE ASSEMBLY ARRANGEMENT FOR AN INJECTION VALVE AND INJECTION VALVE

(71) Applicant: Continental Automotive GmbH, Hannover (DE)

(72) Inventor: Mauro Grandi, Livorno (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 293 days.

(21) Appl. No.: 14/363,828

(22) PCT Filed: Dec. 5, 2012

(86) PCT No.: PCT/EP2012/074498
§ 371 (c)(1),
(2) Date: Jun. 9, 2014

(87) PCT Pub. No.: WO2013/083626
PCT Pub. Date: Jun. 13, 2013

(65) Prior Publication Data

US 2015/0041569 A1 Feb. 12, 2015

(30) Foreign Application Priority Data

Dec. 7, 2011 (EP) ..... 11192409

(51) Int. Cl.
*B05B 1/30* (2006.01)
*F02M 51/06* (2006.01)
(Continued)

(52) U.S. Cl.
CPC ..... *F02M 51/0603* (2013.01); *F02M 47/06* (2013.01); *F02M 61/08* (2013.01)

(58) Field of Classification Search
CPC .. F02M 51/0603; F02M 61/08; F02M 45/086; F02M 63/0061; F02M 63/0064; B05B 1/323
(Continued)

(56) References Cited

U.S. PATENT DOCUMENTS 5,383,647 A 1/1995 Jorach et al. ..... 251/63.6
5,669,355 A * 9/1997 Gibson ..... F02G 5/00 123/446
(Continued)

FOREIGN PATENT DOCUMENTS

DE 19857338 C1 10/2000 ..... F02M 47/02
DE 19916965 A1 11/2000 ..... F02M 47/06
(Continued)

OTHER PUBLICATIONS

European Search Report and Written Opinion, Application No. 11192409.8, 6 pages, dated Jun. 4, 2012.
(Continued)

*Primary Examiner* — Arthur O Hall
*Assistant Examiner* — Adam J Rogers
(74) *Attorney, Agent, or Firm* — Slayden Grubert Beard PLLC

(57) ABSTRACT

A valve assembly arrangement for an injection valve may have a central longitudinal axis, a valve assembly of the inward opening type, and a valve assembly of the outward opening type, wherein the valve assembly of the outward opening type is axially arranged adjacent and fixedly coupled to the valve assembly of the inward opening type such that the valve assembly of the inward opening type is operable to inject fluid into the valve assembly of the outward opening type for increasing a fluid pressure in the valve assembly of the outward opening type to open the valve assembly of the outward opening type to enable
(Continued)

dispensing of the fluid from the valve assembly arrangement.

16 Claims, 2 Drawing Sheets

(51) Int. Cl.
*F02M 47/06* (2006.01)
*F02M 61/08* (2006.01)

(58) Field of Classification Search
USPC ..... 239/585.5, 533.7, 453
See application file for complete search history.

(56) References Cited

U.S. PATENT DOCUMENTS 5,829,688 A * 11/1998 Rembold ..... B23H 9/00 239/585.1
6,168,094 B1 * 1/2001 Schatz ..... F02M 51/0671 239/491
6,213,098 B1 * 4/2001 Kato ..... F02M 45/08 123/300
6,340,121 B1 * 1/2002 Lambert ..... F02M 45/00 239/533.12
6,671,611 B1 * 12/2003 Peltier ..... F02B 61/045 123/478
6,676,035 B2 * 1/2004 Lorraine ..... F02M 51/0603 239/102.2
6,843,434 B2 * 1/2005 Lawrence ..... F02M 45/086 239/533.11
7,124,959 B2 * 10/2006 Baker ..... F02M 43/02 239/5
7,195,182 B2 3/2007 Fischer et al. ..... 239/585.5
7,407,120 B1 * 8/2008 French ..... F02M 51/0675 239/585.5
8,967,502 B2 * 3/2015 Kim ..... F02D 19/0684 123/27 GE
2002/0179062 A1 * 12/2002 Shen ..... F02M 51/0603 123/498
2003/0066509 A1 * 4/2003 Shafer ..... F02D 41/3035 123/305
2003/0160110 A1 8/2003 Boecking ..... 239/96
2003/0201344 A1 * 10/2003 Wark ..... F02M 47/00 239/533.8
2004/0055562 A1 * 3/2004 Stewart ..... F02M 45/02 123/299
2005/0172935 A1 * 8/2005 Magel ..... F02M 45/086 123/446
2008/0053408 A1 * 3/2008 Futonagane ..... F02D 41/2096 123/456
2008/0093484 A1 * 4/2008 Stoecklein ..... F02M 47/02 239/585.5
2008/0245891 A1 * 10/2008 Mochizuki ..... F02M 51/0603 239/88
2009/0321668 A1 * 12/2009 Venkataraghavan ..... F02M 47/027 251/129.01
2012/0187218 A1 * 7/2012 Kim ..... F02D 19/0647 239/417.5
2012/0255523 A1 * 10/2012 Kim ..... F02D 19/0647 123/478

FOREIGN PATENT DOCUMENTS

DE 102008044157 A1 6/2010 ..... F02M 45/08
EP 1516116 B1 4/2006 ..... F02M 51/06
EP 2011995 A2 1/2009 ..... F02M 47/02
EP 2378106 A1 10/2011 ..... F02M 51/06
GB 2352780 A 2/2001 ..... F02M 59/34
WO 00/57051 A1 9/2000 ..... F02M 56/06
WO 01/51805 A2 7/2001 ..... F02M 47/00
WO 2010/079010 A1 7/2010 ..... F01N 3/20
WO 2013/083626 A1 6/2013 ..... E02M 47/06

OTHER PUBLICATIONS

International Search Report and Written Opinion, Application No. PCT/EP2012/074498, 11 pages, dated Jan. 22, 2013.
Korean Office Action, Application No. 2018051001147, 4 pages, dated Jul. 27, 2018.

* cited by examiner

VALVE ASSEMBLY ARRANGEMENT FOR AN INJECTION VALVE AND INJECTION VALVE

CROSS-REFERENCE TO RELATED APPLICATIONS

This application is a U.S. National Stage Application of International Application No. PCT/EP2012/074498 filed Dec. 5, 2012, which designates the United States of America, and claims priority to EP Application No. 11192409.8 filed Dec. 7, 2011, the contents of which are hereby incorporated by reference in their entirety.

TECHNICAL FIELD

The invention relates to a valve assembly arrangement for an injection valve and an injection valve.

BACKGROUND

Injection valves are in wide spread use, in particular for internal combustion engines where they may be arranged in order to dose the fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter and also various elements of the injection valve being responsible for the way the fluid is dosed may vary in a wide range. In addition to that, injection valves may accommodate an actuator for actuating a needle of the injection valve, which may, for example, be an electromagnetic actuator or piezo electric actuator.

In order to enhance the combustion process in view of the creation of unwanted emissions, the respective injection valve may be suited to dose fluids under very high pressures. The pressures may be in case of a gasoline engine, for example, in the range of up to 200 bar and in the case of diesel engines in the range of up to 2000 bar.

Solenoid driven injectors are normally designed as so-called inward opening injectors. A typical example for an inward opening injector is disclosed in EP 2 378 106 A1.

SUMMARY

One embodiment provides a valve assembly arrangement for an injection valve the valve assembly arrangement having a central longitudinal axis and comprising a valve assembly of the inward opening type and a valve assembly of the outward opening type, wherein the valve assembly of the outward opening type is axially arranged adjacent to and fixedly coupled to the valve assembly of the inward opening type in such fashion that the valve assembly of the inward opening type is operable to inject fluid into the valve assembly of the outward opening type for increasing a fluid pressure in the valve assembly of the outward opening type to open the valve assembly of the outward opening type to enable dispensing of the fluid from the valve assembly arrangement.

In a further embodiment, the valve assembly of the inward opening type comprises a first valve body comprising a first cavity with a fluid inlet portion and a fluid outlet portion, a first valve needle axially movable in the first cavity, the first valve needle preventing a fluid flow through the fluid outlet portion in a closing position and releasing the fluid flow through the fluid outlet portion in further positions, an actuator unit being designed to actuate the first valve needle, and a first spring, and wherein the valve assembly of the outward opening type comprises a second valve body comprising a second cavity, a second valve needle, a second spring, a perforated disc, and a sealing portion at an axial end area of the second valve body, the second valve needle being axially movable in the second cavity, thereby preventing a fluid flow along the sealing portion in a closing position and releasing the fluid flow along the sealing portion in further positions.

In a further embodiment, the valve assembly is configured to inject the fluid which is released through the fluid outlet portion into the second cavity for increasing the fluid pressure in the second cavity and dispensing of the fluid along the sealing portion from the valve assembly arrangement.

In a further embodiment, the perforated disc is fixedly coupled to the second valve needle.

In a further embodiment, the second spring is operable to bias the second valve needle towards its closing position by means of mechanical interaction with the perforated disc.

In a further embodiment, the second cavity comprises a step for limiting axial displacement of the perforated disc.

In a further embodiment, the actuator unit is an electromagnetic actuator unit.

In a further embodiment, the actuator unit is of the piezo type.

Another embodiment provides an injection valve with a valve assembly arrangement having any of the features disclosed above.

BRIEF DESCRIPTION OF THE DRAWINGS

Exemplary embodiments of the invention are explained below with reference to the drawings, in which.

DETAILED DESCRIPTION

Figure 1:
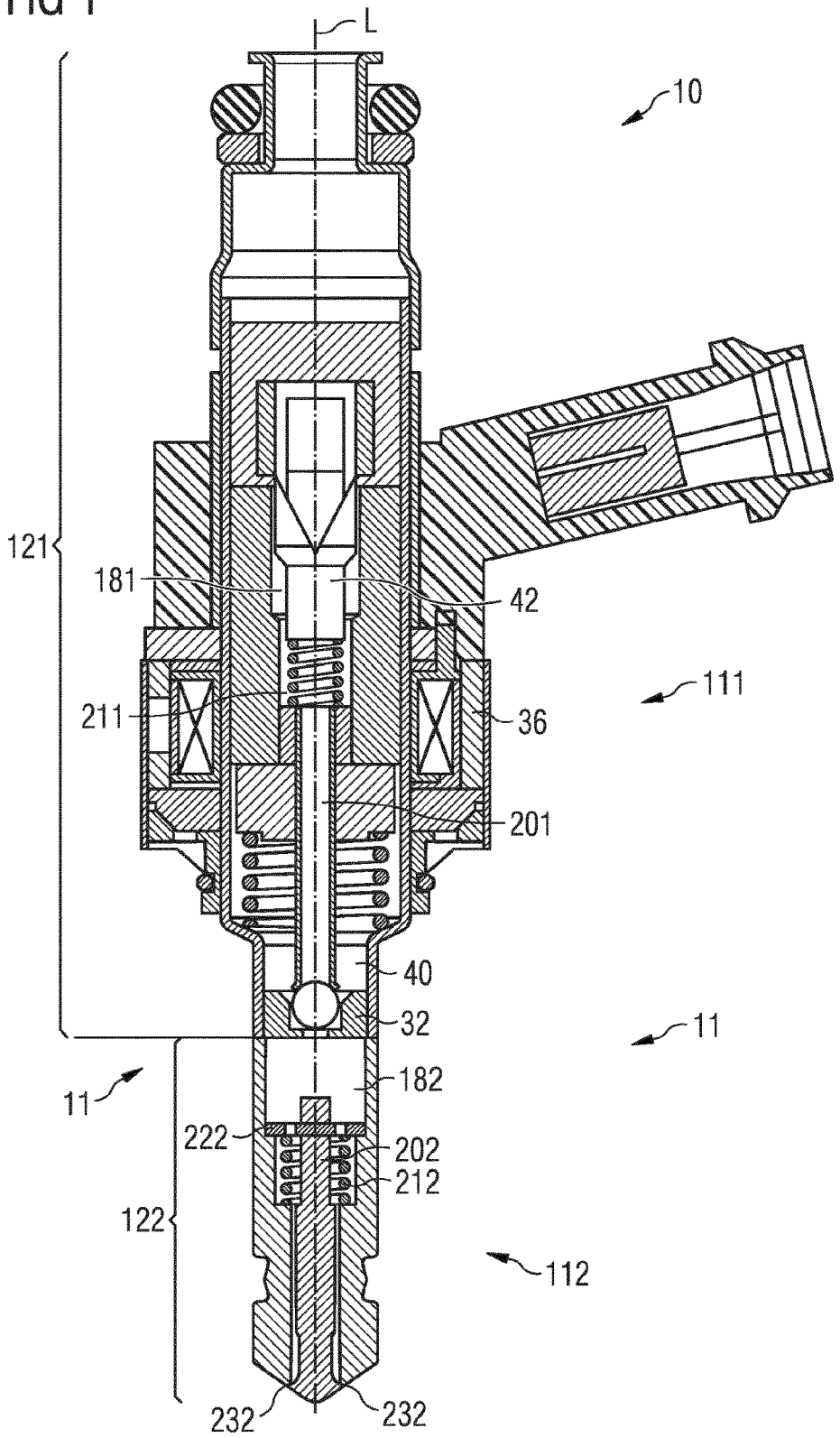
FIG. 1 shows an injection valve with a valve assembly arrangement in a longitudinal section view.

Embodiments of the present invention provide a valve assembly arrangement for an injection valve and an injection valve which facilitate a reliable and precise function.

According to one aspect, a valve assembly arrangement, sometimes also called a valve assembly means, for an injection valve is specified. According to another aspect, an injection valve with the valve assembly arrangement is specified.

The valve assembly arrangement has a central longitudinal axis and comprises a valve assembly of the inward opening type and a valve assembly of the outward opening type. The valve assembly of the outward opening type is axially arranged adjacent to and fixedly coupled to the valve assembly of the inward opening type. For example, the valve assemblies share a common valve body.

In one embodiment, each of the valve assemblies has a cavity and a valve needle which is received in the respective cavity. The valve needle of the valve needle of the inward opening type is in particular arranged completely in the cavity of the valve assembly of the inward opening type.

In case of the valve assembly of the inward opening type, the valve needle, which in particular facilitates injection, may end in a ball shaped portion, which rests—in a closed position of the valve needle—on a seat plate which may be a portion of a valve body of the valve assembly of the inward opening type. When actuated for injecting fluid, the valve needle moves contrary to the direction into which fluid moves during injection, thereby moving off from the seat plate and thus opening the nozzle or nozzles provided in the seat plate for dispensing fluid to the outside of the valve assembly of the inward opening type. A typical example for a valve assembly of the inward opening type is disclosed in EP 2 378 106 A1, the disclosure content of which in this respect is hereby incorporated by reference.

The valve needle of the valve assembly of the outward opening type in particular extends through an orifice which is in hydraulic communication and arranged downstream of the cavity of the valve assembly of the outward opening type. Fluid is in particular dispensed by the valve assembly arrangement through the orifice.

In one embodiment, the valve assembly of the outward opening type is axially arranged adjacent to and fixedly coupled to the valve assembly of the inward opening type in such fashion that the valve assembly of the inward opening type is operable to inject fluid into the valve assembly of the outward opening type—in particular into its cavity—for increasing a fluid pressure in the valve assembly of the outward opening type to open the valve assembly of the outward opening type to enable dispensing of the fluid from the valve assembly arrangement, in particular through the orifice.

By means of the valve assembly of the outward opening type, particularly advantageous exhaust emissions characteristics are achievable, in particular as compared to inward opening injectors. At the same time, the valve assembly arrangement is advantageously free of a bellows, which is needed in so called hydraulically balanced outward opening injectors. In hydraulically balanced outward opening injectors, the bellows is a separation component for maintaining the pressurized fuel within the valve body. The bellows diameter is such that in respect to the sealing tip diameter the fuel pressure either always supports the injector closing position or is balanced to not apply any load to the injector tip. A typical example for such an injector is disclosed in EP 1 516 116 B1. This design is rather complex and due to the bellows presence it becomes complicated to develop a fuel supply line.

In addition, and contrary to so called hydraulically unbalanced injectors, the fluid pressure which applies force to the outward opening needle in the direction of opening is, with advantage, controlled by means of the valve assembly of the inward opening type. Therefore, the risk that the injector is opened without being activated by an electrical signal in an uncontrolled way, is reduced as compared to a hydraulically unbalanced outward opening injector.

In one embodiment, the valve assembly of the inward opening type comprises a first valve body comprising a first cavity with a fluid inlet portion and a fluid outlet portion, a first valve needle axially movable in the first cavity, the first valve needle preventing a fluid flow through the fluid outlet portion in a closing position and releasing the fluid flow through the fluid outlet portion in further positions and an actuator unit being designed to actuate the first valve needle. The actuator unit is, for example, an electro-magnetic actuator unit or an actuator unit of the piezo type. The valve assembly of the inward opening type may further comprise a first spring.

In one embodiment, the valve assembly of the outward opening type comprises a second valve body comprising a second cavity, a second valve needle and a sealing portion at an axial end area of the second valve body. The second valve needle is in particular axially movable in the second cavity for preventing a fluid flow along the sealing portion in a closing position and releasing the fluid flow along the sealing portion in further positions. In particular, the second valve needle, in the closing position, abuts the sealing portion of the second valve body for preventing fluid flow through the orifice.

In one development, the valve assembly of the outward opening type further comprises a second spring. In another development, the valve assembly of the outward opening type additionally or alternatively comprises a perforated disc. In one embodiment, the perforated disc is fixedly coupled to the second valve needle.

The second spring may be preloaded by the perforated disc at least in the closing position of the second valve needle, in particular for biasing the second valve needle against the second valve body for preventing the valve assembly arrangement from dispensing fluid, in particular through the orifice.

In one embodiment, the second cavity comprises a step. In one development, the step is operable to limit axial displacement of the perforated disc.

In one embodiment, the valve assembly arrangement is configured to inject the fluid which is released through the fluid outlet portion of the valve assembly of the inward opening type into the second cavity for increasing the fluid pressure in the second cavity and dispensing of the fluid along the sealing portion of the valve assembly of the outward opening type from the valve assembly arrangement.

An injection valve 10 that is in particular suitable for dosing fuel to an internal combustion engine comprises in particular a valve assembly arrangement 11.

The valve assembly arrangement 11 comprises a valve assembly 111 of the inward opening type and a valve assembly 112 of the outward opening type, whereby the valve assembly 112 of the outward opening type is arranged, axially along a central longitudinal axis L of the valve assembly arrangement 11, adjacent to and fixedly coupled to the valve assembly 111 of the inward opening type.

The valve assembly 111 of the inward opening type is basically constructed like the valve assembly of the injection valve described in already mentioned EP 2 378 106 A1, which is also of the inward opening design, and functions generally in the same way. Accordingly, hereinafter only those details of the valve assembly 111 of the inward opening type are described, which directly act together with the valve assembly 112 of the outward opening type during operation.

The valve assembly 111 of the inward opening type comprises a first valve body 121 including a first cavity 181 with a fluid inlet portion 42 and a fluid outlet portion 40. The first cavity 181 takes in a first valve needle 201, an actuator 36 and a first spring 211. The actuator unit 36 may be of the solenoid type as shown in FIG. 1 and in EP 2 378 106 A1 as already mentioned herein before, or of the piezo type. The actuator unit 36 acts, when being energized, (directly or indirectly) on the first valve needle 201 in axial direction thus moving the first valve needle 201 out from its closing position into an opening position for injecting fuel. Moving the first valve needle 201 into its closing position is established by means of said first spring 211 shown in FIG. 1, when the actuator unit 36 is de-energized.

In a closing position of the first valve needle 201 it sealingly rests on a seat plate 32 thus preventing a fluid flow through at least one injection nozzle arranged inside of and through the seat plate 32. The injection nozzle may be, for example, an injection hole. However, it may also be of some other type suitable for dosing fluid.

Figure 2:
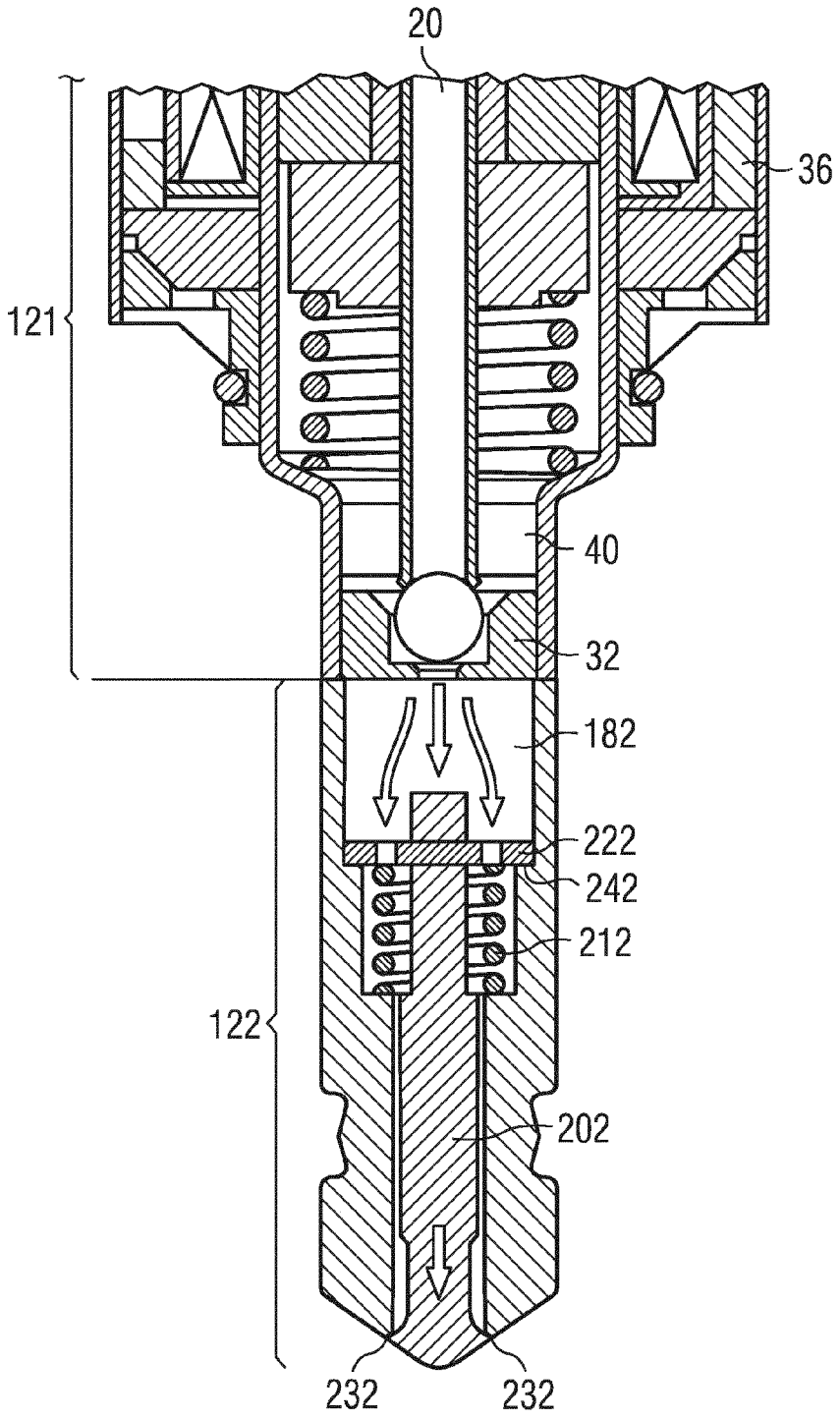
FIG. 2 shows an enlarged view of a section of the valve assembly arrangement.

Axially along the central longitudinal axis L and adjacent to the valve assembly 111 of the inward opening type there is arranged and fixedly coupled to a valve assembly 112 of the outward opening type. In an overall view this can be seen in FIG. 1, and in FIG. 2 this is shown in more detail. The valve assembly 112 of the outward opening type comprises a second valve body 122, which, in turn, comprises a second cavity 182, a second valve needle 202, a second spring 212, a perforated disc 222 and a sealing portion 232 at an axial end area of the second valve body 122.

The second valve needle 202 is axially movable in the second cavity 182, thereby preventing a fluid flow along the sealing portion 232 in a closing position and releasing the fluid flow along the sealing portion 232 in further positions. The perforated disc 222 is fixedly coupled to the second valve needle 202. The second spring 212 is preloaded by the perforated disc 222 in the closing position of the second valve needle 202. And it is advantageous, that the second cavity 182 comprises a step 242.

In the following, the function of the injection valve 10 is described:

The valve assembly 111 of the inward opening type basically functions like the valve assembly of the injection valve as disclosed in already mentioned EP 2 378 106 A1: when the actuator 36 is energized, the first valve needle 201 axially moves from its closing position towards its further positions thereby releasing fluid flow through the fluid outlet portion 40 and enabling fluid injection into the valve assembly 112 of the outward opening type. Accordingly, the pressure of the fluid in the valve assembly 112 of the outward opening type increases and causes the perforated disc 222 to move towards the second spring 212. As the perforated disc 222 is fixedly coupled to the second valve needle 202, the second valve needle 202 also moves, in the same direction as the perforated disc 222 moves. This moving causes the second valve needle 202 to lift from the sealing portion 232 and thereby enables the fluid to leave the valve assembly 112 of the outward opening type for being injected, for example, into a cylinder of an internal combustion engine. When the actuator 36 is de-energized, the first spring 211 and the second spring 212 are decompressed for a certain amount thereby causing the first and the second valve needles 201, 202 to move into their respective closing positions; injection is finished until the next occurrence of energizing the actuator unit 36.

At least some embodiments provide the advantage of that in situations in which the fluid pressure applied to the injection valve 10 and to the fluid inlet portion 40 increases, and where the valve needles 201, 202 are in their closing positions, this increasing pressure is not transferred to the second valve needle 202 of the valve assembly 112 of the outward opening type (what would decrease the effective closing force acting onto the second valve needle 202), because the first valve needle 201 of the valve assembly 111 of the inward opening type, is closed.

What is claimed is:

1. A valve assembly arrangement for an injection valve, the valve assembly arrangement comprising:

a central longitudinal axis running from a fluid inlet to a fluid outlet in a fluid flow direction, a first valve needle disposed in a first valve cavity, the first valve needle opening inwardly toward the fluid inlet, and a second valve needle disposed in a second valve cavity, the second valve needle opening outwardly toward the fluid outlet, wherein the second valve needle is arranged downstream of the first valve needle in the fluid flow direction along the central longitudinal axis;

wherein opening the first valve needle injects fluid into the second valve cavity by moving the first valve needle away from the second valve needle toward the fluid inlet along the central longitudinal axis for increasing a fluid pressure in the second valve cavity, and opening the second valve needle dispenses the fluid from the valve assembly arrangement when the second valve needle moves toward the fluid outlet away from the inward opening valve assembly along the central longitudinal axis.

2. The valve assembly arrangement of claim 1, further comprising an inward opening valve assembly including:

the first cavity having a respective fluid inlet portion and a respective fluid outlet portion, the first valve needle axially movable in the first cavity along the central longitudinal axis to prevent a fluid flow through the fluid outlet portion in a closing position of the first valve needle and to release the fluid flow through the fluid outlet portion in further positions of the first valve needle, an actuator unit configured to actuate the first valve needle along the central longitudinal axis, and a first spring, and an outward opening valve assembly including the second cavity, the second valve needle, a second spring, a perforated disc, and a sealing portion at an axial end area of the second valve body, and wherein the second valve needle is axially movable in the second cavity along the central longitudinal axis, thereby preventing a fluid flow along the sealing portion in a closing position of the second valve needle and releasing the fluid flow along the sealing portion in further positions of the second valve needle.

3. The valve assembly arrangement of claim 2, wherein the valve assembly arrangement is configured to inject the fluid that is released through the fluid outlet portion into the second cavity for increasing the fluid pressure in the second cavity and dispensing of the fluid along the sealing portion from the valve assembly arrangement.

4. The valve assembly arrangement of claim 2, wherein the perforated disc is fixedly coupled to the second valve needle.

5. The valve assembly arrangement of claim 2, wherein the second spring is operable to bias the second valve needle towards its closing position along the central longitudinal axis by mechanical interaction with the perforated disc.

6. The valve assembly arrangement of claim 2, wherein the second cavity comprises a step that limits axial displacement of the perforated disc.

7. The valve assembly arrangement of claim 2, wherein the actuator unit comprises an electro-magnetic actuator unit.

8. The valve assembly arrangement of claim 2, wherein the actuator unit comprises a piezo actuator.

9. An injection valve comprising:

a valve assembly arrangement having a central longitudinal axis running from a fluid inlet to a fluid outlet in a fluid flow direction, a first valve needle disposed in a first cavity, the first valve needle opening inwardly toward the fluid inlet, and a second valve needle disposed in a second cavity, the second valve needle opening outwardly toward the fluid outlet, wherein the second valve needle is axially arranged downstream of the first valve needle in the fluid flow direction along the central longitudinal axis such that opening the first valve needle injects fluid into the second cavity by moving the first valve needle away from the second valve needle toward the fluid inlet along the central longitudinal axis for increasing a fluid pressure in the second cavity, and opening the second valve needle dispenses the fluid from the injection valve when the second valve needle moves away from the inwardly opening valve assembly toward the fluid outlet along the central longitudinal axis.

10. The injection valve of claim 9, further comprising an inward opening valve assembly including:

the first cavity having a respective fluid inlet portion and a respective fluid outlet portion, the first valve needle axially movable in the first cavity along the central longitudinal axis to prevent a fluid flow through the fluid outlet portion in a closing position of the first valve needle and to release the fluid flow through the fluid outlet portion in further positions of the first valve needle, an actuator unit configured to actuate the first valve needle along the central longitudinal axis, and a first spring, and an outward opening valve assembly including a second valve body comprising the second cavity, the second valve needle, a second spring, a perforated disc, and a sealing portion at an axial end area of the second valve body, and wherein the second valve needle is axially movable in the second cavity along the central longitudinal axis, thereby preventing a fluid flow along the sealing portion in a closing position of the second valve needle and releasing the fluid flow along the sealing portion in further positions of the second valve needle.

11. The injection valve of claim 10, wherein the valve assembly arrangement is configured to inject the fluid that is released through the fluid outlet portion into the second cavity for increasing the fluid pressure in the second cavity and dispensing of the fluid along the sealing portion from the valve assembly arrangement.

12. The injection valve of claim 10, wherein the perforated disc is fixedly coupled to the second valve needle.

13. The injection valve of claim 10, wherein the second spring is operable to bias the second valve needle towards its closing position by mechanical interaction with the perforated disc.

14. The injection valve of claim 10, wherein the second cavity comprises a step that limits axial displacement of the perforated disc.

15. The injection valve of claim 10, wherein the actuator unit comprises an electro-magnetic actuator unit.

16. The injection valve of claim 10, wherein the actuator unit comprises a piezo actuator.

* * * * *